US005188270A

United States Patent [19]

Hiramatsu et al.

[11] Patent Number: 5,188,270

[45] Date of Patent: Feb. 23, 1993

[54] SHEET CONVEYOR HAVING RETRACTABLE PINS HELD IN A WHEEL FOR OPENINGS IN A SHEET

[75] Inventors: Soichi Hiramatsu, Tokyo; Kenichiro Hashimoto, Yokohama, both of Japan

[73] Assignee: Canon Kabushiki Kaisha, Tokyo, Japan

[21] Appl. No.: 845,840

[22] Filed: Mar. 6, 1992

Related U.S. Application Data

[63] Continuation of Ser. No. 555,809, Jul. 23, 1990, abandoned, which is a continuation of Ser. No. 328,815, Mar. 24, 1989, abandoned, which is a continuation of Ser. No. 883,748, Jul. 9, 1986, abandoned.

[30] Foreign Application Priority Data

| | | | |
|---|---|---|---|
| Jul. 15, 1985 | [JP] | Japan | 60-154181 |
| Jul. 15, 1985 | [JP] | Japan | 60-154182 |
| Oct. 16, 1985 | [JP] | Japan | 60-230393 |

[51] Int. Cl.[5] ..... B65H 20/20

[52] U.S. Cl. ..... 226/76; 400/616.3; 226/87; 226/81

[58] Field of Search ..... 226/76, 78, 81, 87; 400/616.3, 616

[56] References Cited

U.S. PATENT DOCUMENTS

| | | | |
|---|---|---|---|
| 2,815,672 | 12/1957 | Storer | 226/81 |
| 3,825,162 | 7/1974 | Hubbard | 226/74 |
| 4,022,365 | 5/1977 | Weller | 226/87 X |
| 4,033,493 | 7/1977 | Levinson | 226/87 X |
| 4,036,420 | 7/1977 | Lockwood | 226/87 |
| 4,129,239 | 7/1978 | Hubbard | 226/75 |
| 4,133,613 | 1/1979 | Webster | 400/616.3 |
| 4,571,104 | 2/1986 | Jung et al. | 226/76 X |

FOREIGN PATENT DOCUMENTS

| | | | |
|---|---|---|---|
| 597443 | 5/1960 | Canada | 400/616.3 |
| 50-85307 | 7/1975 | Japan . | |
| 55-144050 | 10/1980 | Japan . | |

*Primary Examiner*—Daniel P. Stodola
*Assistant Examiner*—Paul Bowen

[57] ABSTRACT

A sheet conveyor for conveying a sheet by engaging an engaging member with openings formed in a sheet and conveying the sheet by displacement of the engaging member. The conveyor includes a holding device for holding the engaging member so as to be movable between an operative position and a retracted position retracted from the operative position, a device deformable to move the engaging member provided on the holding device between the operative position and the retracted position, and a drive device for driving the holding device to displace the engaging member.

46 Claims, 13 Drawing Sheets

SHEET CONVEYOR HAVING RETRACTABLE PINS HELD IN A WHEEL FOR OPENINGS IN A SHEET

This application is a continuation of application Ser. No. 07/555,809, filed Jul. 23, 1990, which is a continuation of application Ser. No. 07/328,815, filed Mar. 24, 1989, which is a continuation of application Ser. No. 06/883,748, filed Jul. 9, 1986, all now abandoned.

BACKGROUND OF THE INVENTION 1. Field of the Invention

This invention relates to a sheet conveyor applied to an image recording apparatus such as a printer, a typewriter, a laser beam printer or an electrophotographic copying apparatus. More particularly, the present invention relates to a sheet conveyor for engaging an engaging member with openings formed in a sheet and conveying the sheet by displacing the engaging member.

2. Related Background Art

Various structures have been proposed as paper feeding mechanisms used, for example, in printers, and one of them is a pin feed mechanism.

This pin feed mechanism has a structure in which a pin wheel rotatable with a platen is provided near the platen and pins projecting from the pin wheel are fitted in through-holes formed along the opposite side edges of recording paper at the same pitch as the interval between the pins, thereby effecting paper feed.

This pin feed mechanism is generally classified into two types, i.e., the pull type as shown in FIG. 1 of the accompanying drawings and the push-in type as shown in FIG. 2 of the accompanying drawings.

In a pull type mechanism recording paper 1 is guided along a paper guide 2 and between a platen 3 and a recording head 4, the recording paper 1 is urged against the platen 3 by a bail roller 6, the pins 5*a*of a pin wheel 5 are fitted into the feed holes of the recording paper and the recording paper is pulled and thereby fed. Designated by 4*a* is a recording portion which effects recording on the recording paper 1.

Denoted by 7 in FIG. 1 is a carriage carrying the recording head 4 thereon, and recording is effected while the carriage 7 is moved along a guide shaft 8. When recording of one line is completed, the pin wheel 5 is rotated by a predetermined angle by the drive force from a drive source (not shown), and the recording paper is fed by an amount corresponding to one line. Where such a pull type pin wheel mechanism is used, if an attempt is made to feed the recording paper in reverse, there is the possibility of the feeding of the recording paper becoming unstable.

Also, the distance from the upper end of the recording paper to the recording starting position is required to be equal to at least the distance from the recording portion to the pin wheel, and this leads to the problem that the recording paper cannot be used effectively.

In such a pull type pin feed mechanism, the pin wheel is situated on the outlet side of the recording paper, whereas in the push-in type pin feed mechanism, the pin wheel is situated on the recording paper side as shown in FIG. 2.

In FIG. 2, portions identical or corresponding to those in FIG. 1 are given similar reference characters and need not be described.

In a push-in type pin feed mechanism, the pin wheel is situated on the inlet side of the recording paper and therefore, the recording starting position of the recording paper is at a very short distance from the upper end of the recording paper and thus, the recording paper can be used effectively. However, in a push-in type pin feed mechanism, the recording paper is pushed in and paper feed is effected by resorting to the rigidity of the recording paper and therefore, if the distance from the pin wheel to the recording position is long, there is the possibility of the conveyance of the recording paper becoming unstable.

Also, in the push-in type pin feed mechanism, the recording paper 1 is urged against the platen 3 by the bail roller 6, and the friction feed of the platen 3 rotated for the conveyance of the recording paper is combined with the friction of the conveyance force of the push-in by the pin wheel 5, but adjustment of the strengths of the two conveying forces is difficult and also is liable to be affected by the kind, temperature, etc. of the recording paper, and this also leads to the possibility of the conveyance of the recording paper becoming unstable.

Also, both the pull type pin feed mechanism and the push-in type pin feed mechanism require a considerable installation space, and this hinders to the compactness of the recording apparatus.

To solve such problems, a structure as shown in FIGS. 3 and 4 of the accompanying drawings has been proposed.

Designated by 9 in these Figures is a pin wheel to which a rotational force is transmitted by a drive source, not shown, through a feed shaft 10. A plurality of through-holes 9*a* are formed in the pin wheel 9 at predetermined angular intervals circumferentially thereof, and a pin 11 is slidably fitted in each of the through-holes 9*a*. A fixed cam 12 is disposed on the outer side of the pin wheel 9, as shown in FIG. 4, and a rail portion 12*a* is provided on the inner side of the fixed cam 12.

Two projections 11*a* and 11*a* provided on the sides of each pin 11 sandwich the rail portion 12*a* therebetween, and with rotation of the pin wheel 9, the pins 11 move into and out of the pin wheel 9.

This reciprocation of pins 11 is determined by the shape of the rail portion 12*a*.

In the example shown, when the pins come to the recording head 4 side, the pins move into the pin wheel 9. Also, the pins are adapted to protrude from the pin wheel when they are at a position far from the recording head 4. Thus, under the pin wheel 9, the recording paper 1 is nipped between the pin wheel 9 and the paper guide 2 so that the feed holes do not come off the pins 11. Above the pin wheel 9, the recording paper 1 is nipped between a paper keeper 13 and the pin wheel 9 so that the feed holes do not come off the pins 11. It is for the purpose of avoiding the interference with the recording head 4 that on the recording head side, the pins 11 move into the pin wheel.

As shown in FIG. 4, a pin feed body 14 is disposed on the inner side of the pin wheel 9, and with the aforementioned fixed cam 12, it is prevented from rotating by a pin feed guide shaft 15.

The pin wheel 9 is disposed at each end of the platen 3 and therefore, if such a structure is adopted, pin feed is effected near the recording position and the mating of the feed holes of the recording paper and the pins is possible upstream and downstream of the recording position. Also, both during forward rotation and during reverse rotation, stable conveyance of the recording paper can be realized, and the distance from the upper end of the recording paper to the recording starting position becomes shorter and the recording paper can be utilized effectively.

Also, the pin wheels can be disposed coaxially with the platen and therefore, the installation space can be reduced and compactness of the device can be realized.

However, in spite of the above-described advantages, the pin feed mechanism in which the pins move into and out of the pin wheel suffers from the following problem.

That is, the pins protruding under the pin wheel 9 are situated at a position which cannot be seen by the user. Therefore, the user must fit the pins into the feed holes when he or she sets recording paper, but it is difficult and cumbersome to do it at a position which cannot be seen.

SUMMARY OF THE INVENTION

It is an object of the present invention to provide a sheet conveyor in which the operability of sheet mounting is improved.

It is another object of the present invention to provide a sheet conveyor which can convey a sheet accurately to a predetermined position.

It is still another object of the present invention to provide a sheet conveyor which can easily mount a sheet thereon.

It is yet still another object of the present invention to provide a sheet conveyor in which the amount by which the pins protrude can be changed and when recording paper is to be set, the pins are retracted to accomplish reliable setting of the recording paper and after the recording paper has been set, the pins protrude to ensure the engagement of the pins with the recording paper and thereby enable reliable conveyance to be accomplished.

DESCRIPTION OF THE PREFERRED EMBODIMENT

Figure 1:
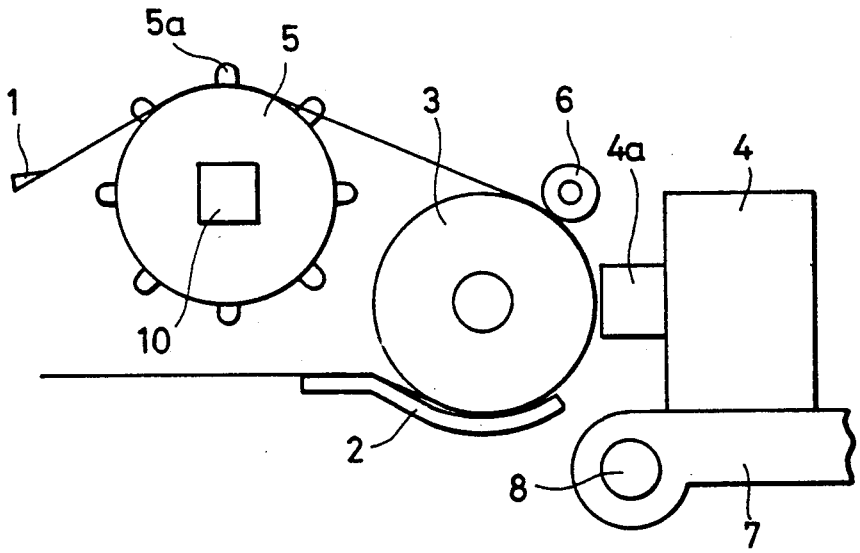
FIG. 1 (PRIOR ART)
FIGS. 1 and 2 are side views of pins feed mechanisms according to the prior art.
Figure 2:
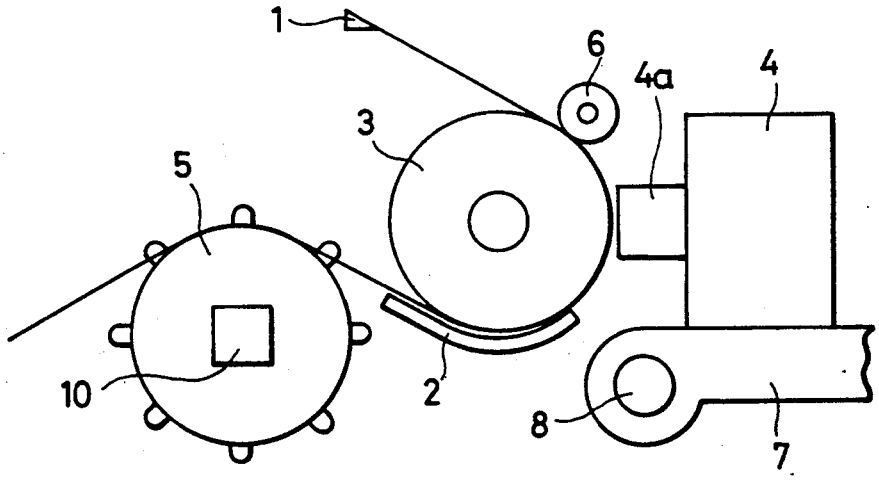
FIG. 2 (PRIOR ART)
Figure 3:
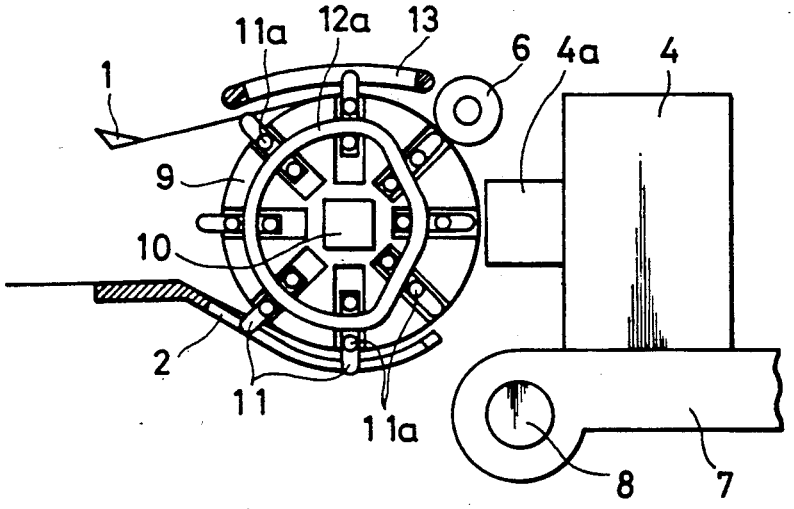
FIG. 3 (PRIOR ART)
FIG. 3 is a longitudinal cross-sectional view of a pin feed mechanism according to the prior art.
Figure 4:
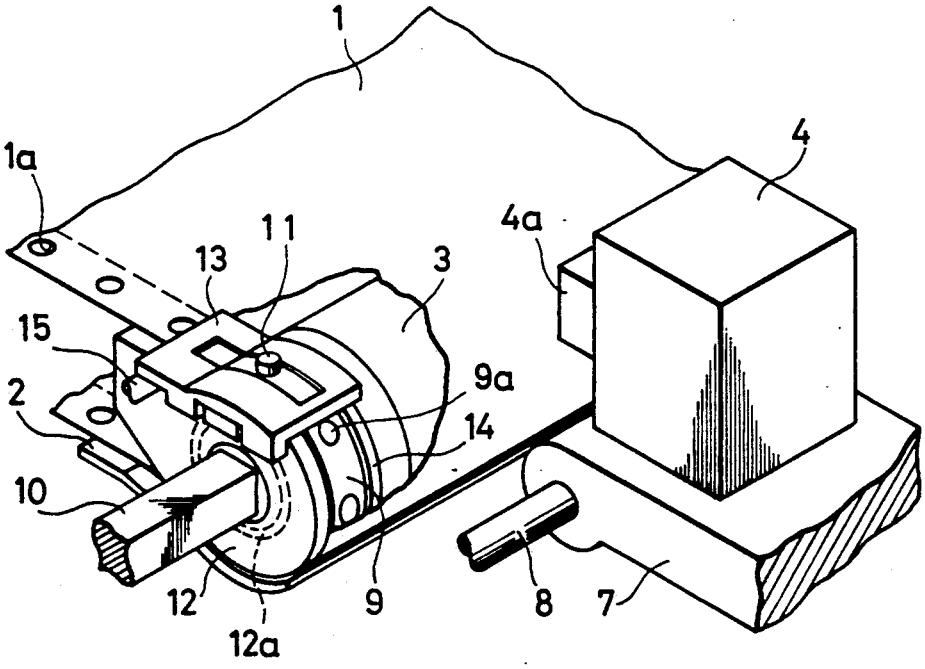
FIG. 4 (PRIOR ART)
FIG. 4 is a perspective view of the pin feed mechanism.

The present invention will hereinafter be described in greater detail with respect to some embodiments thereof.

In a printer having pin wheels fixed to the opposite ends of a platen coaxially therewith, the embodiments described hereinafter are of a structure in which pins are slidably provided radially on the pin wheels and cam means capable of adjusting the amount of protrusion of these pins from the pin wheels is provided, which is extraneously operably.

If the structure as described above is adopted, the amount by which the pins protrude from the pin wheels can be adjusted simply by operating the cam means, and during the setting and conveyance of recording paper, the amount by which the pins protrude can be adjusted to thereby enable reliable setting and conveyance of the recording paper to be accomplished.

The details of the present invention will hereinafter be described with respect to the embodiments thereof shown in the drawings.

FIGS. 5 to 9 illustrate a first embodiment of the present invention. In these Figures, members similar or corresponding to those in FIGS. 1 to 4 are given the same reference characters and need not be described.

Figure 5:
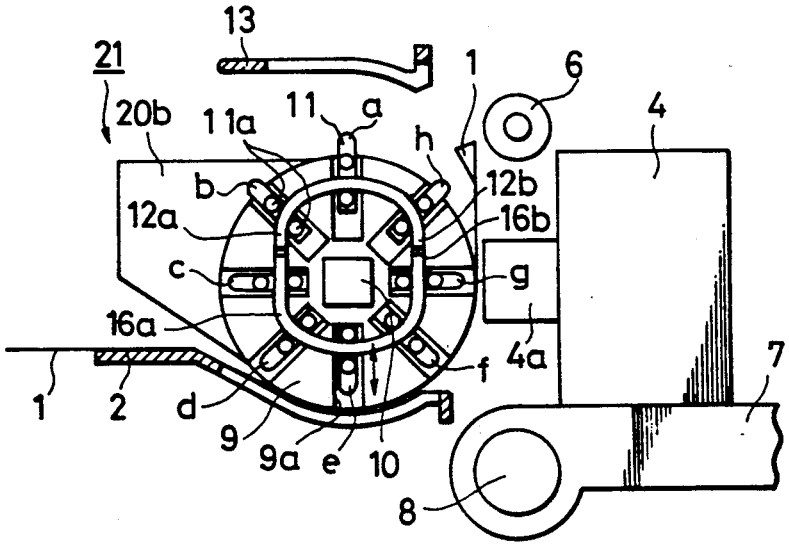
FIG. 5 is a longitudinal cross-sectional view showing recording paper as it is set.
Figure 6:
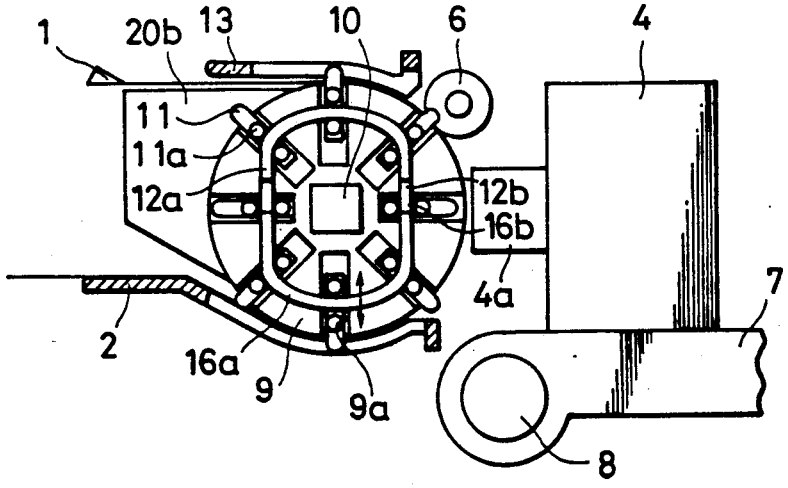
FIG. 6 is a longitudinal cross-sectional view showing the recording paper as it is conveyed.
Figure 7:
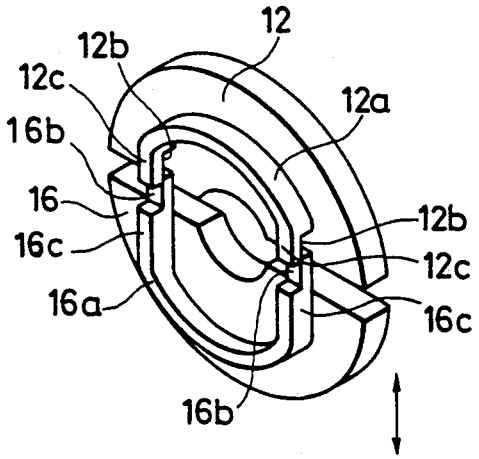
FIG. 7 is a perspective view of a cam portion.
Figure 8:
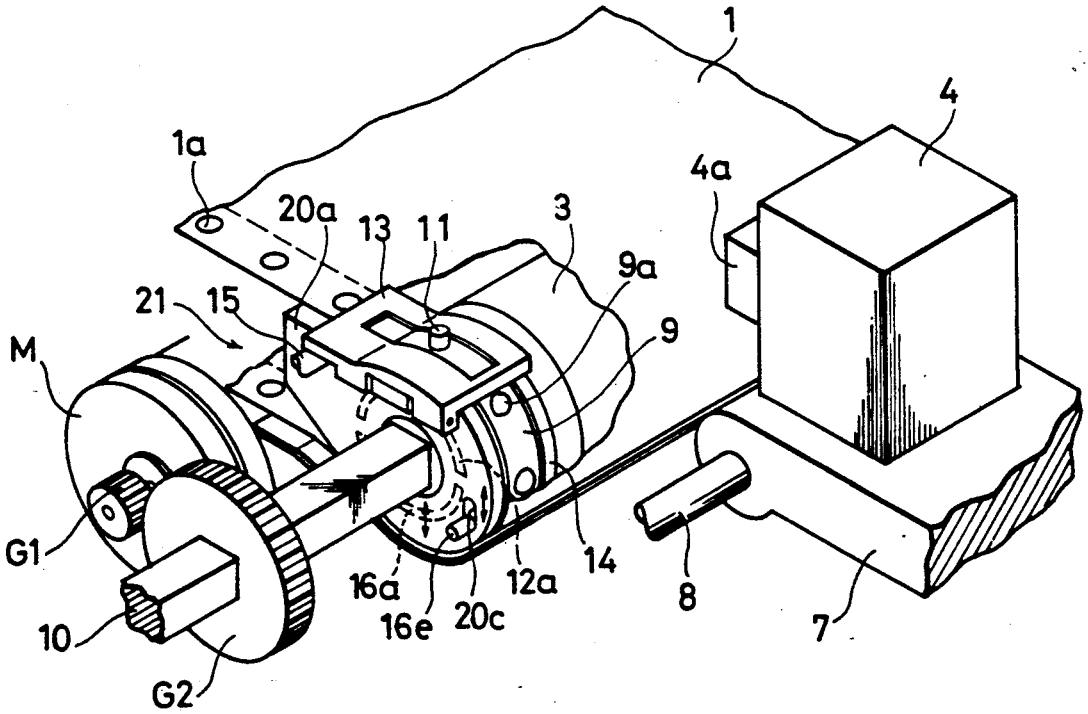
FIG. 8 is a perspective view of a recording paper conveyor using an embodiment of the present invention.
Figure 9:
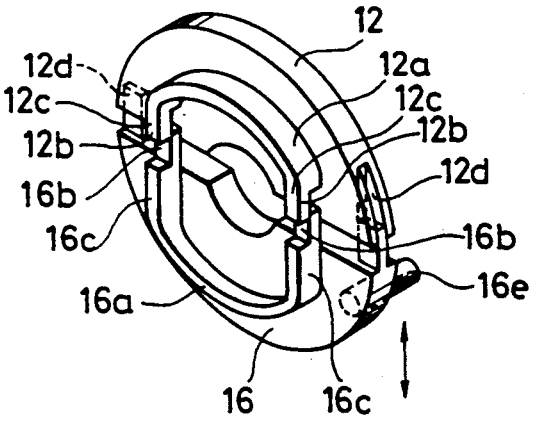
FIG. 9 is a perspective view of a cam portion.

FIG. 5 is a longitudinal cross-sectional side view showing recording paper as it is set, FIG. 6 is a longitudinal cross-sectional side view showing the recording paper as it is conveyed, FIG. 7 is a perspective view of a cam, FIG. 8 is a perspective view of a sheet conveyor, and FIG. 9 is a perspective view of a cam according to another embodiment. FIGS. 5 and 6 show a state in which an outer wall 20*a* (shown in FIG. 8) has been removed, and in these Figures, a rail portion is additionally shown to make the invention easy to understand. Although not shown in FIG. 8, feed rollers are provided on the opposite ends of the platen.

Reference numeral 9 designates a pin wheel having a plurality of holes 9*a* provided radially. A cylinder-like pin 11 is slidably fitted in each of these holes 9*a* and can protrude from or retract into the hole 9*a*. Each of the pins 11 has a projection 11*a* provided on the peripheral surface thereof. In FIG. 5, pins a, b and h protrude from the holes 9*a* and pins c, d, e, f and g are retracted into the holes 9*a*. The pin wheel 9 is sandwiched between a pair of outer walls 20*a* and 20*b* and is rotatably mounted relative to the outer walls 20*a* and 20*b*. This pin wheel 9 is rotated by the drive force of a motor M transmitted thereto by a shaft 10. The drive force of the motor M is transmitted to the shaft 10 through a drive gear G1 and a feed gear G2.

On the other hand, cams 12 and 16 are provided inside the outer wall 20*a*. The cam 12 is fixed to the outer wall 20*a*, while the cam 16 is movable relative to the outer wall 20*a*.

In the present embodiment, the fixed cam 12 is semicircular and a side surface thereof is provided with a rail portion 12*a*, and the semicircular movable cam 16 is vertically movably and provided below the fixed cam 12, and the outer side surface thereof is provided with a semicircular rail portion 16*a*.

Cut-away portions 12*b* and 16*b* are provided in the opposite ends of the rail portions 12*a* and 16*a*, respectively, and by these cut-away portions overlapping each other, the two rail portions 12*a* and 16*a* are engageable with each other.

The cut-away portions 12*b* and 16*b* are formed in the straight portions 12*c* and 16*c* at the opposite ends of the rail portions 12*a* and 16*a*, and these straight portions 12*c* and 16*c* are situated on the side opposed to a recording head and the side opposite thereto.

Since the rail portions 12*a* and 16*a* are fitted between the projections 11*a* of the pins 11, the pins 11 are vertically movable in the holes 9*a* along the outer peripheries of the rail portions 12*a* and 16*a*.

When recording paper 1 is to be mounted on the sheet conveyor 21 under the above-described structure, the operator touches the movable cam 16 from the outside of the outer wall and raises the movable cam 16 upwardly as shown in FIG. 5, thereby making the cut-away portions 12*b* and 16*b* of the rail portions 12*a* and 16*a* overlap each other.

If this is done, the shape of the rail portions 12*a* and 16*a* will be varied into a shape in which the lengths of the straight portions 12*c* and 16*c* have been shortened as viewed in the general tracks of the rail portions.

In this state, as shown in FIG. 5, the rail portion 12*a* is situated upwardly and the rail portion 16*a* is also situated upwardly and as a whole, the rail portions are in their upwardly moved positions. As a result, the pins 11 protrude from the holes 9*a* only on the upper side of the pin wheel. In the Figure, the pins a, b and h protrude from the holes 9*a* and the pins c, d, e, f and g are retracted into the holes 9*a*.

Accordingly, even if the recording paper 1 is inserted between the paper guide 2 of the printer body and the pin wheel 9, there is no protrusion of the pins 11 below the pin wheel 9, thus permitting smooth passage of the recording paper.

If the recording paper 1 thus directed to between the guide 2 and the pin wheel 9 is placed above the pin wheel 9 and the pins 11 are fitted into feed holes 1*a* (provided at the opposite ends relative to the direction in which the recording paper 1 is conveyed) with a paper keeper 13 raised upwardly and then the paper keeper 13 is lowered, the setting of the recording paper 1 to the sheet conveyor 21 will be completed.

If subsequently, the movable cam 16 is lowered as shown in FIG. 6, the amount by which the rail portions 12*a* and 16*a* overlap each other will decrease and the entire rail portions will take a shape in which their straight portions have become longer.

As a result, the pins 11 will protrude also below the pin wheel 9 and will come to be fitted in the feed holes 1*a* of the recording paper.

Thus, above and below the pin wheel 9, the pins 11 are fitted in the feed holes, thereby permitting stable feeding of the recording paper 1. Thereupon, a clear corresponding to image information is formed on the recording paper 1 by the recording head 4.

Operation of the movable cam may be effected through a lever or the like provided integrally with the movable cam 16, although not shown, and the above-described setting of the recording paper may be accomplished by a very simple operation.

The movable cam is changed over to the recording paper setting position and the recording paper conveying position in this manner, whereby it becomes possible to accomplish reliable setting and conveyance of the recording paper.

Another embodiment of the cam will now be described with reference to FIG. 9.

This embodiment enables the vertical movement of the movable cam 16 relative to the fixed cam 12 to be accomplished more accurately at a predetermined position.

In the present embodiment, cut-aways 12*d* are provided in the opposite end portions of the fixed cam 12 and guides 16*d* fitting in the cut-aways 12*d* are provided at the upper ends of the movable cam 16. Thus, according to the present embodiment, the movable cam 16 can vertically move at a predetermined position without causing positional deviation relative to the fixed cam 12.

Further, in the present embodiment, a dowel 16*e* is provided at a side edge of the movable cam 16 and this dowel 16*e* projects from a slot 20*c* in the outer wall 20*a* so that the operator may grasp the dowel 16*e* and thereby vertically move the movable cam 16. Thereby, the operation of vertically moving the movable cam is improved.

The sheet conveyor 21 shown in FIG. 8 is an example in which such dowel 16*e* is provided.

Figure 10:
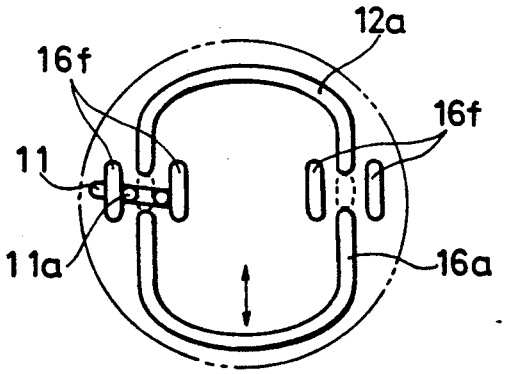
FIG. 10 illustrates a cam portion using another embodiment.

FIG. 10 illustrates still another embodiment of the present invention. In this embodiment, parallel auxiliary rail portions 16*f* and 16*f* project and are provided at the left and right of the opposite ends of the rail portion 16*a* of the movable cam 16 (not shown).

These auxiliary rail portions 16*f* and 16*f* are provided in the portion where the rail portions 12*a* and 16*a* overlap each other, and the spacing between the two is set so as to be capable of guiding the outer sides of two projections 11*a* and 11*a* provided on and projecting from the pin 11.

If such a structure is adopted, the rail portion 16*a* moves up as indicated by the dotted line during the setting of the recording paper and the orbit of the pin 11 is determined with the rail portions 12*a* and 16*a* being nipped between the two projections 11*a* and 11*a* of the pin; but the rail portion 16*a* moves down during the conveyance of the recording paper and the orbit of the pin 11 is determined by the auxiliary rail portions 16*f* and 16*f* nipping the projections 11*a* and 11*a* from the outside thereof.

Adoption of such a structure also leads to an effect similar to that of the aforedescribed embodiment.

The auxiliary rail portions may also be provided on the fixed cam side.

Figure 11:
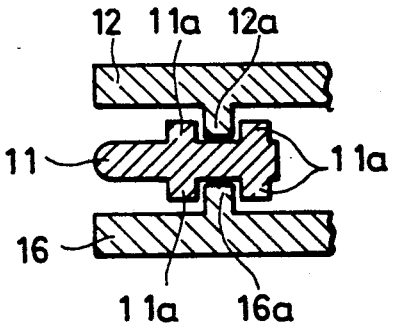
FIG. 11 is an enlarged transverse plan view of the cam portion.

FIG. 11 illustrates yet still a further embodiment of the present invention. In this embodiment, the movable cam 16 and the fixed cam 12 are provided in parallel and overlapping relationship with each other, and the rail portions 12*a* and 16*a* are also provided in opposed relationship with each other.

Two projections 11*a* sandwiching the rail portions 12*a* and 16*a* therebetween are provided on each side of the pin 11.

Adoption of such a structure also enables the movable cam 16 to be vertically moved and the pin 11 to be reliably guided.

Figure 12:
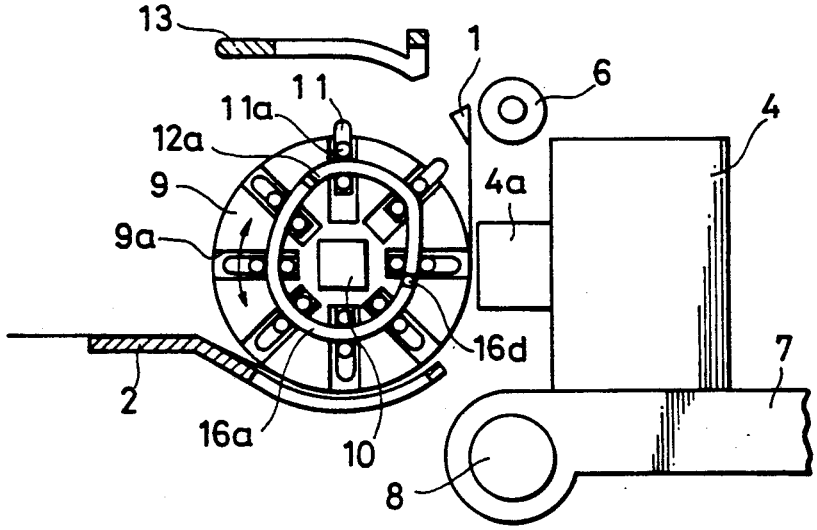
FIG. 12 is a longitudinal cross-sectional side view showing the recording paper as it is set.
Figure 13:
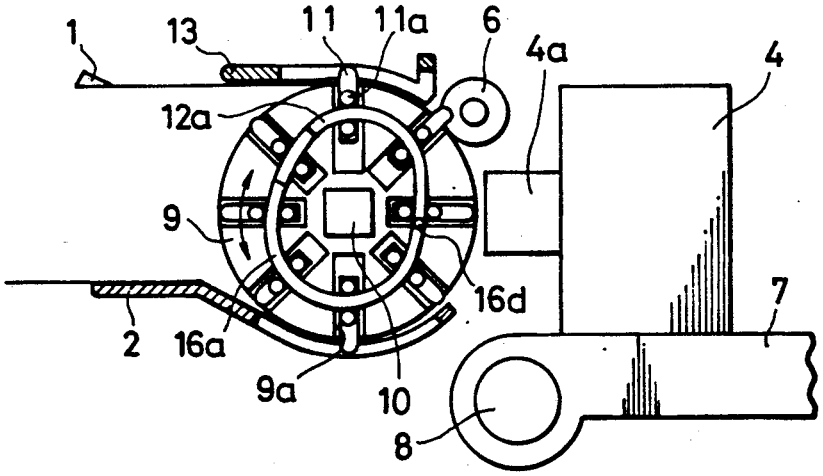
FIG. 13 is a longitudinal cross-sectional side view showing the recording paper as it is conveyed.

FIGS. 12 and 13 illustrate yet still a further embodiment of the present invention. In this embodiment, the rail portion 16*a* of the movable cam (not shown) is made pivotable about a shaft 16*d* relative to the rail portion 12*a* of the fixed cam (not shown), and the portions of the outer ends of the rail portions 12*a* and 16*a* which overlap each other are provided along a circular locus about the shaft 16*d*.

Where such a structure is adopted, the rail portion 16*a* is pivoted about the shaft 16*d* through a movable cam during the setting of recording paper so that the portion of one end of the rail portion 12*a* and the portion of one end of the rail portion 16*a* which overlap each other may be wider, as shown in FIG. 12.

Thereupon, the lower portion of the rail portion 16*a* moves upwardly and under the pin wheel 9, the pins 11 do not protrude.

Accordingly, the recording paper 1 can be set freely.

On the other hand, during the conveyance of the recording paper, if the rail portion 16*a* is pivoted counter-clockwise about the shaft 16*d* as shown in FIG. 13 to thereby reduce the length of the portion of the one end of the rail portion 12*a* and the portion of the one end of the rail portion 16*a* which overlap each other, the lower portion of the rail portion 16*a* will become situated at a low position and under the pin wheel 9 also, the pins 11 will protrude from wheel 9, and thus, in the upper and lower portions of the pin wheel 9, the pins 11 can be fitted into feed holes 1*a*, thereby enabling the recording paper to be fed reliably in either direction.

Adoption of such a structure also leads to an effect similar to that of the above-described embodiments.

Figure 14:
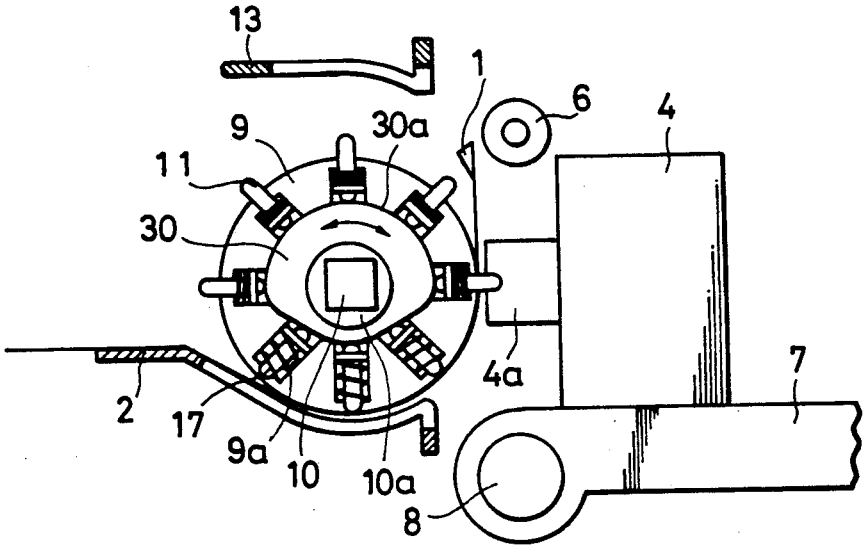
FIG. 14 is a longitudinal cross-sectional side view showing the recording paper as it is set.
Figure 15:
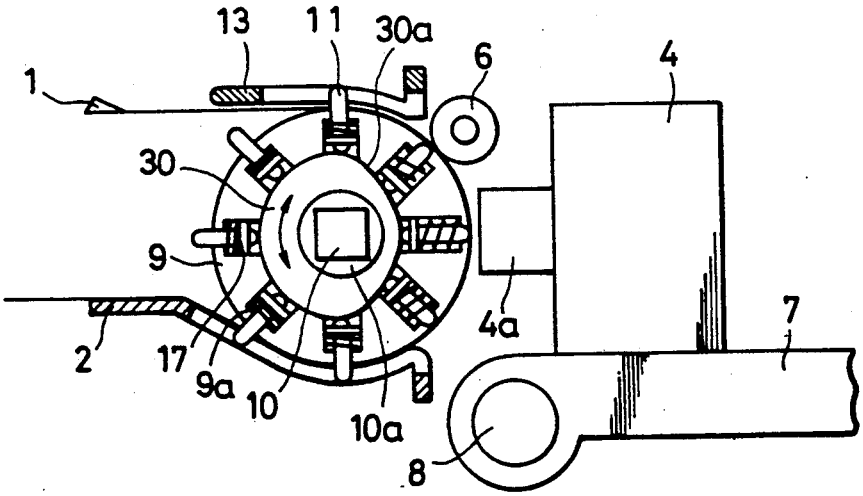
FIG. 15 is a longitudinal cross-sectional side view showing the recording paper as it is conveyed.

FIGS. 14 and 15 illustrate another embodiment of the present invention. In this embodiment, a movable cam 30 is provided for rotation relative to a boss 10*a* fitted to a shaft 10.

Respective pins 11 are normally urged against the cam surface 30*a* of the movable cam 30 by a spring 17.

The present embodiment is constructed as described above and therefore, during the setting of recording paper, when the movable cam 30 is rotated so that the major axis thereof becomes horizontal, the lower portion of the movable cam 30 provides the minor axis and under the pin wheel 9, the pins 11 do not protrude from the pin wheel 9.

When the movable cam 30 is rotated counterclockwise by 90° as shown in FIG. 15 after the setting of the recording paper has been completed in this state, the major axis thereof becomes vertical and therefore, above and below the pin wheel 9, the pins 11 protrude to enable paper feed to be reliably accomplished.

In the embodiment shown in FIGS. 14 and 15, there is shown a structure in which the pins 11 are urged toward the movable cam 30 by the spring 17, but alternatively, a structure may be adopted in which a rail portion is provided on the movable cam 30 and the rail portion is sandwiched between two projections provided on each pin 11.

Now, each of the above-described embodiments have been shown by taking as an example a serial printer in which recording is effected while the carriage is moved in a direction orthogonal to the direction in which recording paper is fed, but the present invention is equally applicable to a line printer in which recording is effected in the direction in which recording paper is fed.

Also, the present invention is likewise applicable to a printer such as a wire dot printer, an ink jet printer or a thermal printer if they are provided with a pin feed mechanism.

Still another embodiment will hereinafter be described with reference to FIGS. 16 to 18.

The embodiment described hereinafter is one in which pins are slidably provided radially in the pin wheel and a cam member for adjusting the amount by which these pins protrude is provided and operatively associated with a bail roller.

Designated by 36*a* in the Figures is a bail roller shaft. The bail roller shaft 36*a* has its lower end journalled to the upper end of a bail roller arm 47 pivotally supported about a shaft 48. The shaft 48 can serve also as the guide shaft of the carriage. A plurality of bail rollers 36 are provided at intervals on the bail roller shaft 36*a*. The bail rollers 36 urge recording paper 1 against the platen 3.

One end of an arm gear 49 is pivotally connected to the bail roller shaft 36*a*. The arm gear 49 is in mesh engagement with the gear portion 50*a* of a cam gear 50 rotatably journalled to the round shaft portion 40*a* of a feed shaft 40 so that the cam gear 50 is rotated to the left and right through the arm gear 49 by the pressure contact and separation of the bail rollers 36 with respect to the platen 3. Also, in a portion of the cam gear 50, there is formed a cam slot 50*b* with a predetermined locus. In the embodiment illustrated, the cam slot 50*b* is voluted.

A movable cam 46 is formed in a U-shape and has one end thereof pivotally supported about a shaft 46*c*, and a projection 46*d* fitted in cam slot 50*b* is provided substantially at the center of the movable cam. A rail portion 46*a* is also provided on the movable cam 46, and the free end of the movable cam 46 and one end of the rail portion 42*a* of a fixed cam 42 overlap each other as shown, for example, in FIG. 7, and the rail portions 42*a* and 46*a* together form a predetermined track.

Operation of the present embodiment constructed as described above will now be described.

Figure 16:
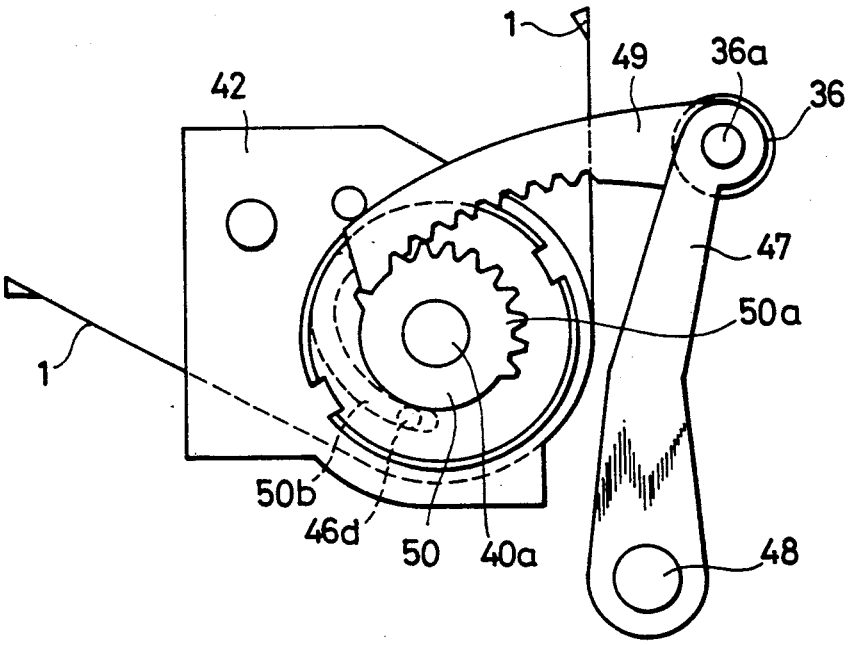
FIG. 16 is a side view showing the recording paper as it is set.

During the setting of recording paper 1, the bail rollers 36 are rotated clockwise about the shaft 48 as viewed in FIG. 16. As a result, the arm gear 49 is also rotated clockwise and the cam gear 50 is also rotated in the same direction. At this time, the projection 46*d* of the movable cam 46 comes to lie on that side of the cam slot 50*b* which is nearest to the feed shaft 40 and the lower portion of the movable cam 46 assumes its most elevated position.

Figure 17:
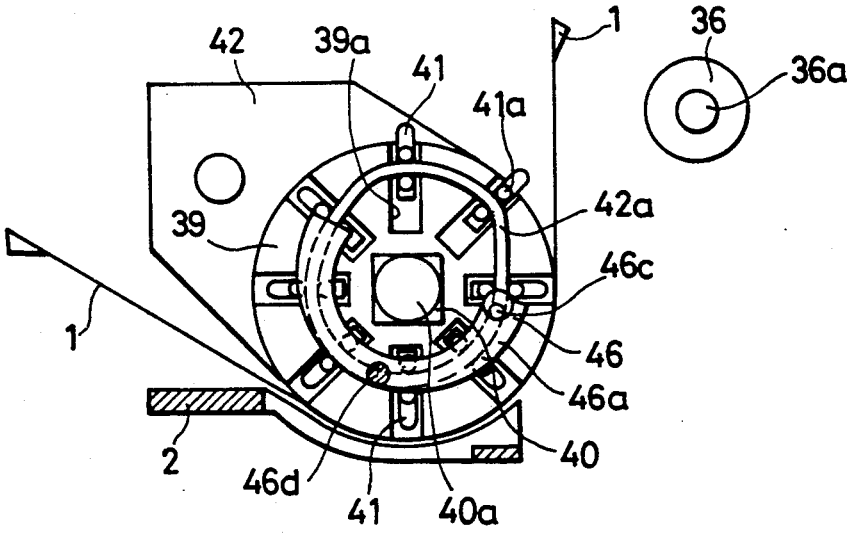
FIG. 17 is a longitudinal cross-sectional side view showing the recording paper as it is set.

Accordingly, as shown in FIG. 17, the pin 41 is in a state in which it does not protrude under the pin wheel 39. In this state, the recording paper may be inserted into the setting position. Designated by 42 is a fixed cam.

Figure 18:
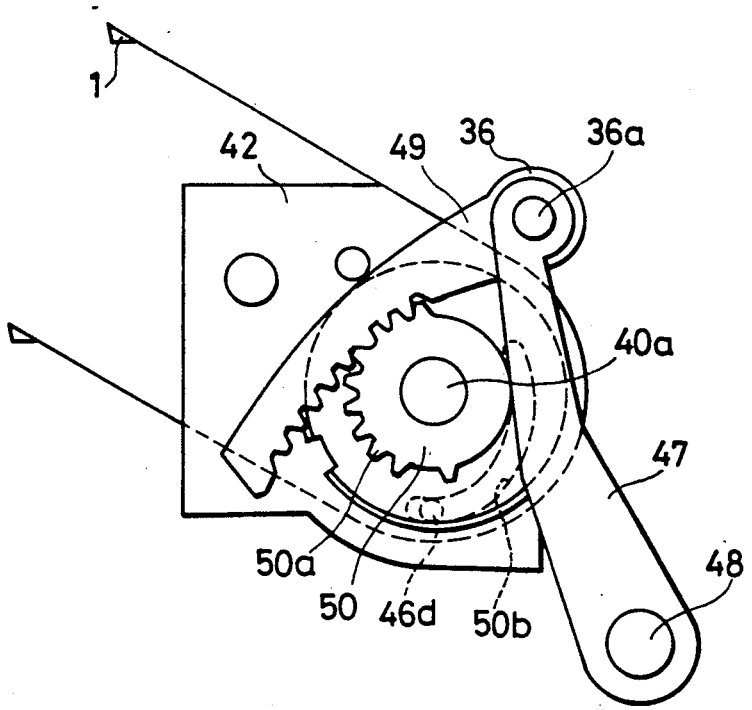
FIG. 18 is a side view showing the recording paper as it is conveyed.
Figure 19:
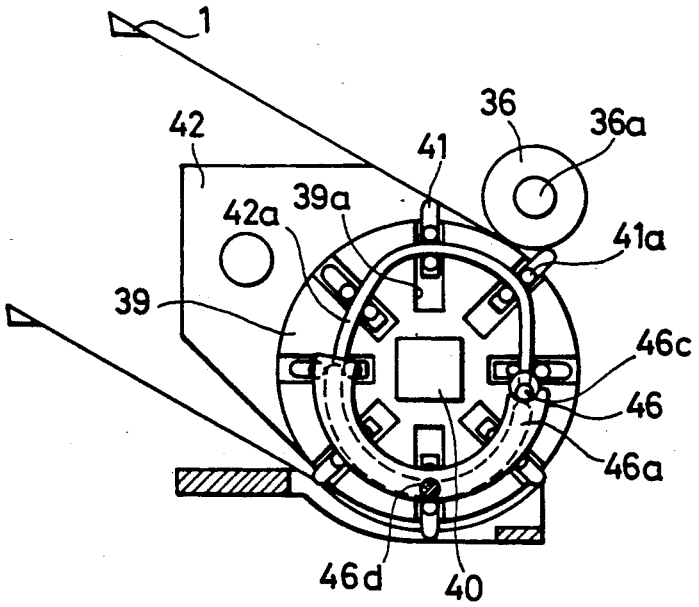
FIG. 19 is a longitudinal cross-sectional side view showing the recording paper as it is conveyed.

Subsequently, as shown in FIGS. 18 and 19, the bail rollers 36 are rotated in a direction in which they are urged against the platen, i.e., in a counterclockwise direction as viewed in FIG. 18. As a result arm gear 49 is moved forward and the cam gear 50 is rotated counter-clockwise and thus, the projection 46*d* of the movable cam 46 is guided to the position of the cam slot 50*b* which is remotest from the feed shaft 40.

As a result, the lower portion of the movable cam 45 is moved to its lowermost position as shown in FIG. 19, and under the pin wheel 39, the pins 41 protrude and are fitted into the feed holes of the recording paper 1.

In this manner, the amount of protrusion of the pins of the pin wheel is changed in conformity with the pressure contact and separation, respectively, of the bail rollers with respect to the platen to thereby enable reliable setting and conveyance of the recording paper to be accomplished.

Although the above-described embodiment has been shown with respect only to an example in which the present invention is applied to a so-called serial printer, the present invention can be applied to any of line printers and dot printers which adopt a pin feed system.

As is apparent from the foregoing description, the present embodiment adopts a structure in which cam means for adjusting the amount by which the pins of the pin wheel protrude is provided and operatively associated with the pressure contact state and the separated state of the bail rollers with respect to the platen. Therefore, the amount by which the pins of the pin wheel protrude can be automatically adjusted to the set state and the conveyance state of the recording paper simply by moving the bail rollers and thus, the operation of setting the recording paper is greatly simplified.

Still another embodiment of the present invention will hereinafter be described with reference to FIGS. 20 to 27.

The embodiment described hereinafter is a pin feed type sheet conveyor in a recording apparatus characterized in that the protrusion and retraction of pins engaged with the feed holes of a sheet are made variable and the protrusion and retraction of the pins are operatively associated with the opening-closing of the sheet keeper of a pin feed device.

The present embodiment will hereinafter be described more specifically with reference to FIGS. 20 to 27.

FIGS. 20 to 23 show the pin feed type sheet conveyor according to an embodiment of the present invention.

Figure 20:
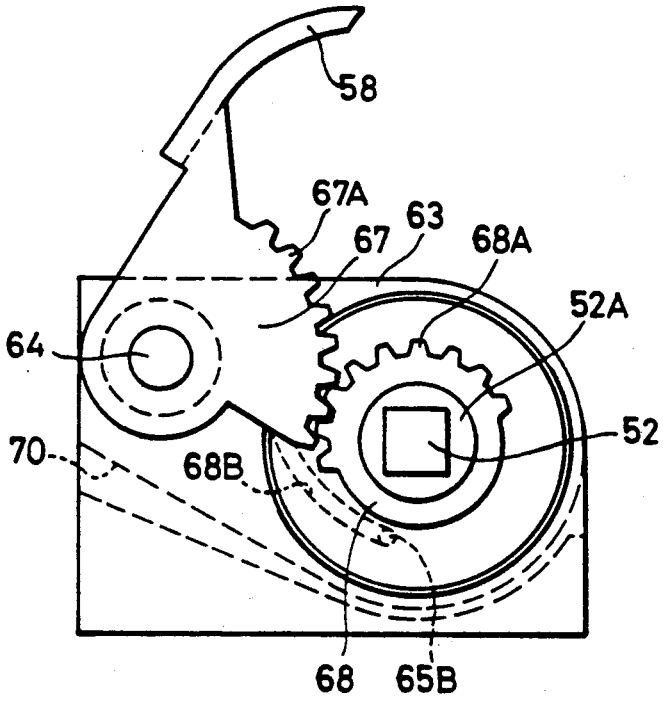
FIGS. 20 and 21 are cross-sectional views showing the state of a pin feed type sheet conveyor during the insertion of a sheet thereinto.
Figure 21:
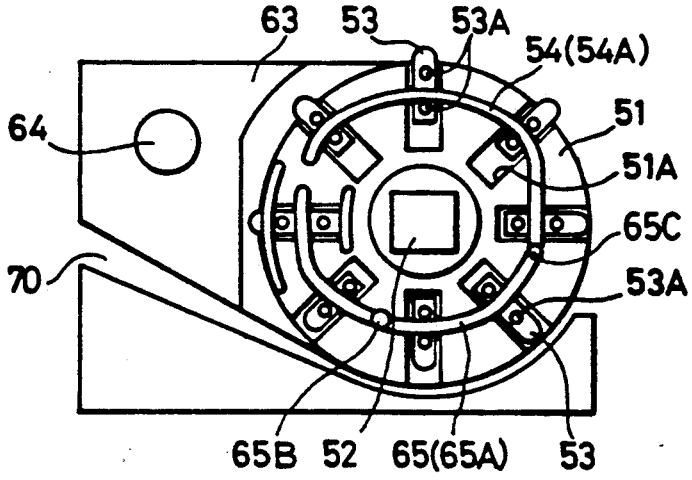

FIGS. 20 and 21 show cross-sections of the sheet conveyor when a sheet has been inserted thereinto.

A sheet keeper 58 rotates about a sheet keeper shaft (in the example shown, a pin feed guide shaft) 64 and assumes an opened position (FIG. 20) along the peripheral surface of a feed roller 51 and a closed position (FIG. 22) retracted from said opened position. An arm gear 67 is formed integrally with the sheet keeper 58, and a gear portion 67A, arcuately shaped about the sheet gear shaft 64, is formed on the arm gear 67. The sheet keeper 58 is adapted to cause a sheet 56 to travel along the peripheral surface of the feed roller 51.

A cam gear 68 is rotatably supported on the round shaft portion 52A of a feed shaft 52, and rotation is transmitted thereto by the arm gear 67 through the gear portion 68A of the cam gear 68. That is, the cam gear 68 is adapted to rotate to the left and right in conformity with the opening and closing of the sheet keeper 58. A cam slot 68B is formed in the cam gear 68 so that the distance of a cam projection 65B provided on a movable cam 65 (FIG. 21) from the center of the round shaft portion 52A of the feed shaft 52 is varied in accordance with the rotation of the cam gear 68. In FIG. 20, the cam gear 68 is rotated clockwise and the cam projection 65B is set to a position near the round shaft portion 52A of the feed shaft by the cam slot 68B.

The movable cam 65 provided with the cam projection 65B is rotatable about a center of movement 65C (FIG. 21). Designated by 63 is a pin feed body.

In FIGS. 20 and 21, the cam projection 65B is drawn toward the center of the round shaft portion 52A of the feed shaft by the cam slot 68B and the movable cam 65 is generally drawn up. Therefore, a movable cam rail portion 65A provided on the movable cam 65 is also drawn toward the center of the feed shaft and forms a generally pulled up track. Pins 53 generally revolve about the feed shaft 52 with the rotation of a pin feed roller 51. Also, the pins 53 are slidable radially along the concave pin guide portions 51A of the pin feed roller 51, and pin projections 53A are provided at the opposite sides of the rail portions 54A and 65A of fixed cam 54 and movable cam 65 and therefore, the orbits of the pins 53 (the protrusion from and retraction into the guide portions 51A) are determined by the fixed cam rail portion 54A and the movable cam rail portion 65A.

In FIGS. 20 and 21, the movable cam rail portion 65A is in its pulled up state and therefore, the orbits of the pins 53 are in their retracted state in the lower portion of the pin feed roller 51.

As described above, by the sheet keeper 58 being brought into its opened state, the movable cam 65 is brought into its pulled up state through the arm gear 67 and the cam gear 68, and the orbits of the pins 53 are in their retracted state in the lower portion of the pin feed roller. Accordingly, in the position of FIGS. 20 and 21, the insertion of the sheet 56 into a path 70 can be accomplished easily and smoothly.

Figure 22:
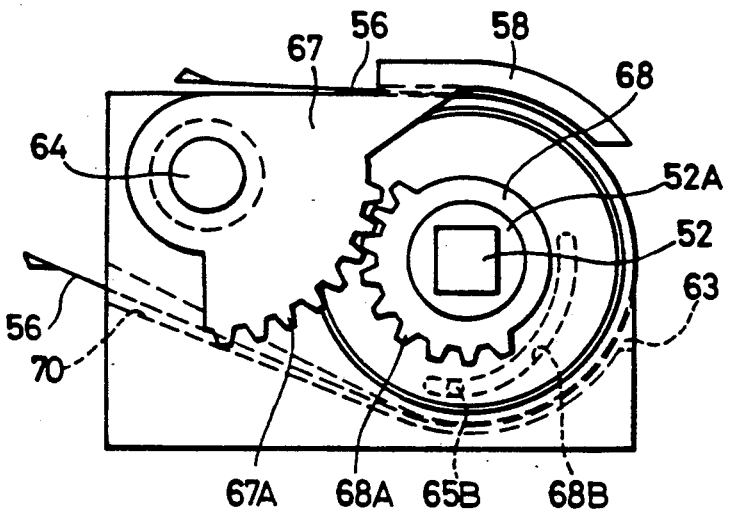
FIGS. 22 and 23 are cross-sectional views showing the state of the conveyor during the setting of the sheet.
Figure 23:
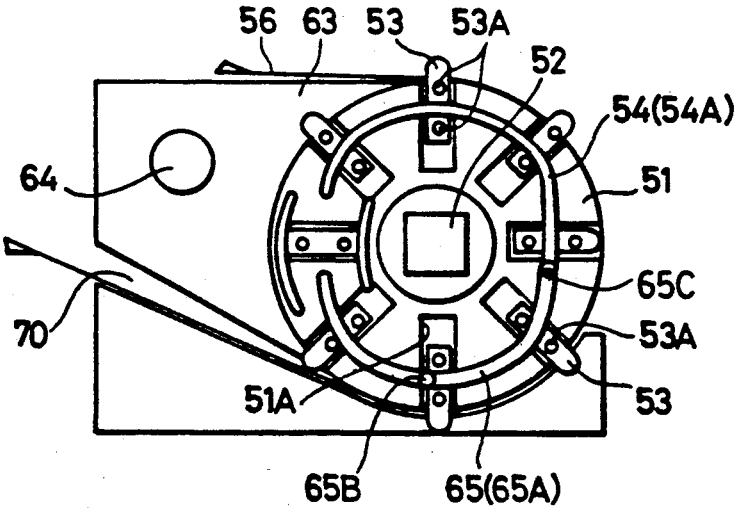

FIGS. 22 and 23 show the state after the setting of the sheet 56 has been completed.

When the sheet keeper 58 is closed, the arm gear 67 rotates the cam gear 68 counterclockwise about the round shaft portion 52A of the feed shaft. Therefore, by the cam slot 68B formed in the cam gear 68, the cam projection 65B of the movable cam 65 is downwardly move away from the axis of the feed shaft 52.

Accordingly, the movable cam 65 rotates about the center of movement 65C and the movable cam rail portion 65A provided on the movable cam 65 is generally pulled down.

With the movable cam rail portion 65A being thus pulled down, the orbits of the pins 53 become protruded in the lower portion.

The orbits in the portion where the fixed cam rail portion 54A and the movable cam rail portion 65A overlap each other depict an arc about the center of rotation 65C of the movable cam, whereby the overlapping of the fixed cam rail portion 54A and the movable cam rail portion 65A may be accomplished by the change-over of the pulling-up and the pulling-down of the movable cam 65.

FIGS. 24 to 27 show a pin feed device according to a further embodiment of the present invention.

Figure 24:
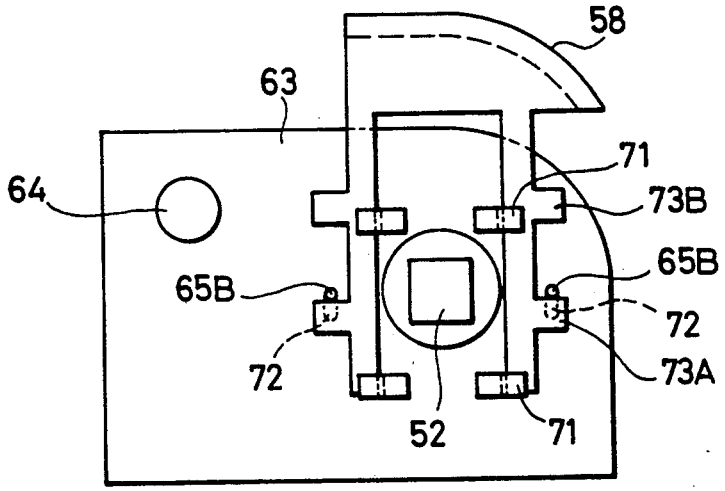
FIGS. 24 and 25 are cross-sectional views showing the state of a sheet conveyor according to another embodiment during the insertion of a sheet thereinto.
Figure 25:
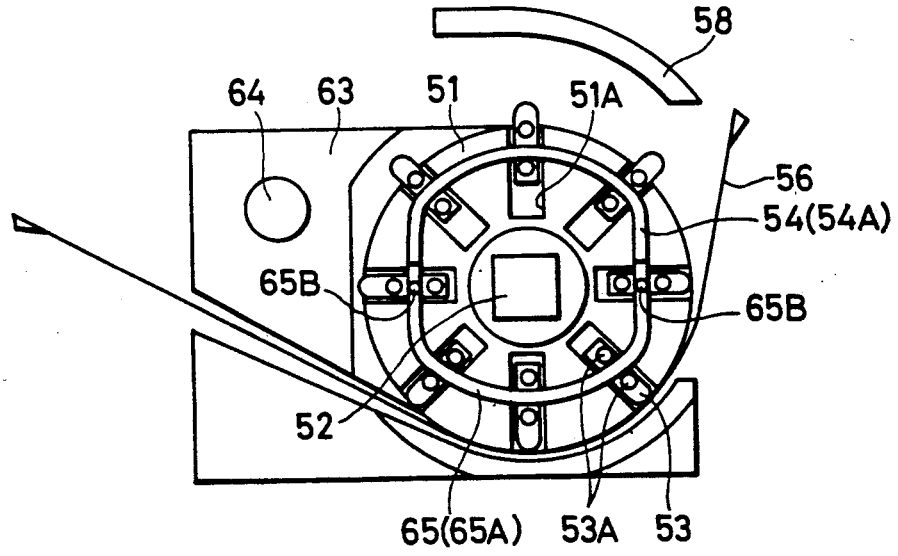

FIGS. 24 and 25 show cross-sections of the pin feed device when a sheet has been inserted thereinto.

A sheet keeper 58 is mounted relative to a pin feed body 63 for upward and downward movement along a guide 71, and the operator may raise the sheet keeper 58 to thereby open it, and may depress the sheet keeper 58 to thereby close it.

A movable cam 65 in the lower half portion is mounted for upward and downward movement in a manner similar to what has been described previously.

Cam projections 65B are provided at two left and right locations on the movable cam 65, and these cam projections 65B protrude toward the sheet keeper 58 through a slot 72 formed in the pin feed body 63.

Engaging portions 73A and 73B, engaging the respective cam projections 65B, are provided on the sheet keeper 58. Thus, by moving up and down (opening and closing) the sheet keeper 58, the movable cam 65 can be moved up and down by a predetermined amount.

In FIGS. 24 and 25, the cam projection 65B is raised by the engaging portion 73A and drawn toward the center of a feed shaft 52, and along therewith, a movable cam rail portion 65A provided on the movable cam 65 is also moved up, whereby the amount of overlap thereof with a fixed cam rail portion 54A is increased.

Pins 53 generally revolve about a feed shaft 52 with the rotation of a pin feed roller 51 and are slidable radially along the pin guide portions 51A of the pin feed roller 51, and pin projections 53A are provided at the opposite sides of a fixed cam rail portion 54A and a movable cam rail portion 65A. Therefore, the orbits (protrusion and retraction) of the pins 53 are determined by these rail portions 54A and 65A.

In FIGS. 24 and 25, the movable cam 65 is pulled up through the cam projections 65B and the movable cam rail portion 65A is also pulled up and therefore, the orbits of the pins 53 are retracted in the lower portion of the pin feed roller 51.

As described above, by opening the sheet keeper 58, the orbits of the pins can be retracted in the lower portion, whereby the insertion of a sheet 56 can be accomplished easily and smoothly.

Figure 26:
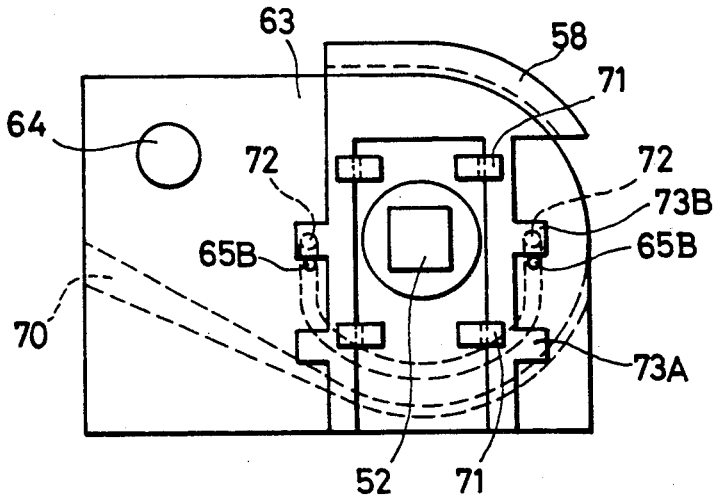
FIGS. 26 and 27 are cross-sectional views showing the state of the conveyor during the setting of the sheet.
Figure 27:
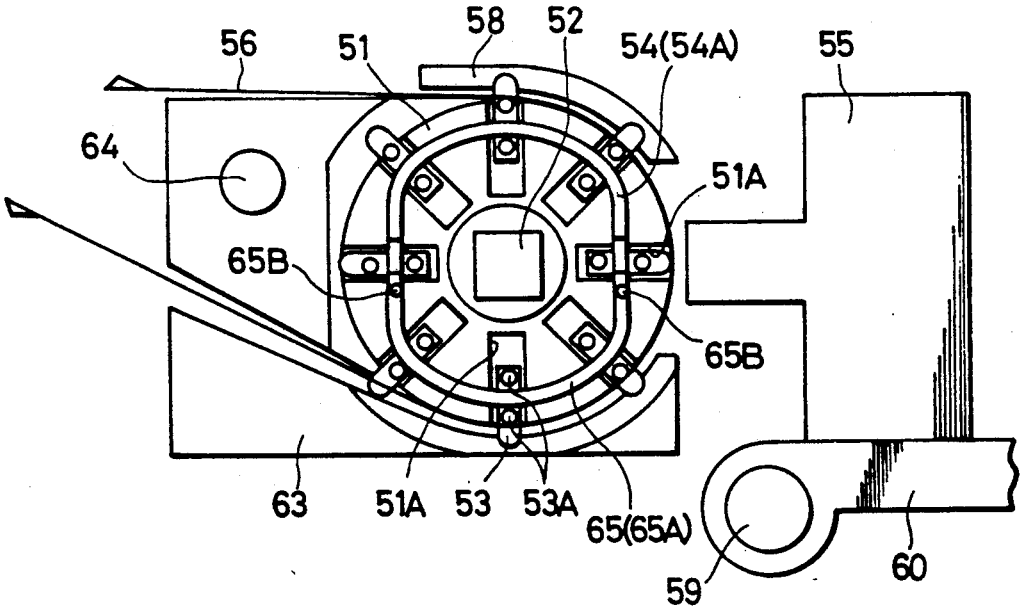

FIGS. 26 and 27 show the state after the setting of the sheet 56 has been completed.

By closing (depressing) the sheet keeper 58, the cam projection 75B is depressed by the engaging portion 73B. Accordingly, the movable cam 65 is depressed and the movable cam rail portion 65A is also depressed and thus, the amount of overlap thereof with the fixed cam rail portion 54A is decreased as shown.

With this depression of the movable cam rail portion 65A, the pins 53 protrude in the lower portion of the pin feed roller 51.

According to each of the above-described embodiments, the pins 53 on the sheet insertion side (the lower portion of the pin feed roller 51) are retracted or extended in response to the movement of the sheet keeper 58, which is opened and closed during the insertion, removal and setting of the sheet 56. Therefore, in the pin feed device of the present invention in which the protrusion and retraction of the pins 53 engaged with the feed holes of the sheet 56 can be varied, the operation during the setting of the sheet can be mitigated and the setting of the sheet can be accomplished easily and stable conveyance of the sheet can be realized.

In the above-described embodiment, there has been shown the case of the serial type recording apparatus in which recording is effected while the recording head is moved by the carriage 60, but each of the above-described embodiments is equally applicable to a line type recording apparatus in which recording is effected line by line, to a a page print type recording apparatus in which recording is effected page by page, and to a color recording apparatus having a plurality of recording heads.

The above-described embodiments are also applicable to any recording apparatuses provided with a pin feed device, such as a wire dot type recording apparatus, a ink jet type recording apparatus and a thermal recording apparatus. Further, in the above-described embodiments, there has been shown an example in which feed holes are formed in the opposite side edge portions of the sheet, whereas the present invention is not restricted thereto, and can be applied to a device in which the feed holes may be formed, for example, in a row in the center of the sheet.

As is apparent from the foregoing description, according to the present invention, there is provided a pin feed device in a recording apparatus in which the operation during the sheet setting can be mitigated and the sheet setting can be accomplished easily and stable sheet conveyance can be realized.

In the above-described embodiments, cylinder-like pins have been described as an example of the members engaged with the feed holes of the sheet, but the present invention is not restricted thereto, the members may be, for example, of a rectangular parallelo-piped shape or the like. Also, in the above-described embodiments, a feed roller has been described as an example of the means for holding the feed pins, but the present invention is not restricted thereto said; the feed pins holding means may be, for example, an endless belt or the like. Further, in the above-described embodiments, the operating means for extraneously adjusting the amount by which the pins protrude has been shown as serving also as a bail roller arm or a sheet keeper, but the present invention is not restricted thereto; the operating means may be operatively associated with another member.

We claim:

1. An apparatus including a sheet conveyor for causing an engaging member to engage an opening formed in a sheet and to convey the sheet, said conveyor comprising:

holding means for holding said engaging member in such a manner that said engaging member is movable between an operative position in which said engaging member engages the opening formed in the sheet and a retracted position retracted from said operative position in which said engaging member is out of engagement with the opening formed in the sheet, said holding means rotating with said engaging member;

drive means for driving and rotating said holding means; and moving means provided along a rotation route of said engaging member so as to engage with said engaging member and guide and move said engaging member between said operative position and said retracted position in response to the rotation of said engaging member, said moving means having a fixed portion for guiding and keeping said engaging member at said operative position when said engaging member moves at a first position on the rotation route and a movable portion movable to guide and keep said engaging member at either said operative position or said retracted position when said engaging member moves at a second position on the rotation route.

2. A sheet conveyor according to claim 1, further comprising a second engaging member and a second holding member, wherein a second opening is formed in the opposite side edge portions of the sheet with respect to the direction of conveyance and said second holding member is positioned to permit engagement between said second engaging member and said second opening.

3. A sheet conveyor according to claim 1, wherein said engaging member comprises a cylinder-like pin.

4. A sheet conveyor according to claim 1, wherein said holding means comprises a pin wheel.

5. An apparatus according to claim 1, wherein said moving means includes a guide member for engaging said engaging member to guide said engaging member.

6. An apparatus according to claim 1, wherein said moving means includes first and second guide members, and said fixed portion is formed on said first guide member and said movable portion is formed on said second guide member.

7. An apparatus according to claim 1, wherein said moving means includes an auxiliary portion disposed between said fixed and said movable portions, said auxiliary portion engaging said engaging member to guide said engaging member to engage with said fixed portion and said movable portion.

8. An apparatus according to claim 1, wherein said drive means includes a motor.

9. An apparatus according to claim 1, further comprising recording means for recording on a sheet conveyed by engaging said engaging member.

10. An apparatus according to claim 1, further comprising a sheet guide for guiding the sheet to a position at which said engaging member engages with the sheet.

11. An apparatus according to claim 10, wherein said sheet guide is movable between a guiding position for guiding the sheet to a position at which said engaging member engages with the sheet and a non-guiding position retracted from the guiding position.

12. An apparatus according to claim 11, wherein said moving means moves said movable portion to keep said engaging member when positioned at the second position at one of the operative position and the retracted position in accordance with movement of said sheet guide.

13. An apparatus according to claim 12, wherein said moving means moves said moveable portion to keep said engaging member when positioned at the second position at the retracted position when said sheet guide moves to the non-guiding position.

14. An apparatus according to claim 13, wherein said moving means includes a cam for engaging said movable portion to move said moveable portion and said cam is moved in accordance with movement of said sheet guide.

15. An apparatus according to claim 14, further comprising a first gear rotating in accordance with movement of said sheet guide and said cam includes a second gear for engaging said first gear to rotate in accordance with movement of said sheet guide.

16. A sheet conveyor for causing an engaging member to engage an opening formed in a sheet and to convey the sheet, said conveyor comprising:

holding means for holding said engaging member in such a manner that said engaging member is movable between an operative position in which said engaging member engages the opening formed in the sheet and a retracted position retracted from said operative position in which said engaging member is out of engagement with the opening formed in the sheet, said holding means rotating with said engaging member;

drive means for driving said rotating said holding means;

moving means provided along a rotation route of said engaging member so as to engage with said engaging member and guide and move said engaging member between said operative position and said retracted position in response to the rotation of said engaging member, said moving means having a fixed portion for guiding and keeping said engaging member at said operative position when said engaging member moves at a first position on the rotation route and movable portion moveable to guide and keep said engaging member at either said operative position or said retracted position when said engaging member moves at a second position on the rotation route; and operating means for operating said movable portion from outside said conveyor.

17. A sheet conveyor according to claim 16, further comprising a second engaging member and a second holding member, wherein a second opening is formed in the opposite side edge portions of the sheet with respect to the direction of conveyance and said second holding member is positioned to permit engagement between said second engaging member and said second opening.

18. A sheet conveyor according to claim 16, wherein said engaging member comprises a cylinder-like pin.

19. A sheet conveyor according to claim 16, wherein said holding means comprises a pin wheel.

20. A sheet conveyor according to claim 16, wherein said operating means comprises a sheet keeper.

21. A sheet conveying apparatus for conveying a sheet, comprising:

a rotatable member for conveying the sheet in response to the rotation of said rotatable member;

a plurality of recesses provided along the peripheral surface of said rotatable member;

a plurality of pins, each of which is arranged movably in one of said recesses between a projecting position in which each pin projects out of one of said recesses and a retracted position in which each pin is retracted from said projecting position, said plurality of pins being engageable with openings provided in the sheet;

fixed engaging means provided along a rotation route of said pin rotating with said rotatable member for engaging with and guiding said pin between said projecting position and said retracted position in response to the rotation of said pins, said fixed engaging means guiding and keeping said pin which is at a first position on the rotation route at said projecting position; and movable engaging means provided along the rotation route and for engaging with said pins rotating along the rotation route to guide and move said pins between said projecting position and said retracted position, said movable engaging means being movable to keep said pins which are at a second position on the rotation route at either said projecting position or said retracted position.

22. A sheet conveying apparatus according to claim 21, wherein said rotatable member comprises a pinwheel.

23. A sheet conveying apparatus for conveying a sheet, comprising:

a rotatable member for conveying the sheet in response to the rotation of said rotatable member;

a plurality of recesses provided along the peripheral surfaces of said rotatable member;

a plurality of pins, each of which is arranged movably in one of said recesses between a projecting position in which each pin projects out of one of said recesses and a retracted position in which each pin is retracted from said projecting position, said plurality of pins being engageable with openings provided in the sheet;

fixed engaging means provided along a rotation route of said pin rotating with said rotatable member for engaging with and guiding said pin between said projecting position and said retracted position in response to the rotation of said pin, said fixed engaging means guiding and keeping said pin which is at a first position on the rotation route at said projecting position; and movable engaging means provided along the rotation route and for engaging with said pin rotating along the rotation route to guide and move said pin between said projecting position and said retracted position in response to the rotation of said pins, said movable engaging means being movable to keep said pin which is at a second position on the rotation route at either said projecting position or said retracted position;

wherein said fixed engaging means maintains said at least one pin at said projecting position when said movable engaging means moves said at least another one of said pins between said retracted and projecting positions.

24. A sheet conveying apparatus for conveying a sheet, comprising:

a rotatable member for conveying the sheet in response to the rotation of said rotatable member;

a plurality of recesses provided along the peripheral surface of said rotatable member;

a plurality of pins, each of which is arranged movably in one of said recesses between a projecting position in which each pin projects out of one of said recesses and a retracted position in which each pin is retracted from said projection position, said plurality of pins being engageable with openings provided in the sheet, said pins rotating with said rotatable member;

fixed engaging means provided along a rotation route of said pin for engaging with and guiding said pin between said projecting position and said retracted position in response to the rotation of said pin, said fixed engaging means guiding and keeping said pin which is at a first position on the rotation route at said projecting position;

movable engaging means provided along the rotation route and for engaging with said pin rotating along the rotation route to guide and move said pin between said projecting position and said retracted position in response to the rotation of said pins, said movable engaging means being movable to keep said pin which is at a second position on the rotation route at either said projecting position or said retracted position;

a sheet holding member movable between an operative position, in which the sheet is held by said rotatable member, and a retracted position in which said sheet holding member is retracted from said operative position; and synchronizing means for displacing said movable engaging means in synchronism with the movement of said sheet holding member between said operative position and said retracted position.

25. A sheet conveying apparatus according to claim 24, wherein said movable engaging means moves said at least another one of said pins to said projecting position in response to movement of said sheet holding member to said operative position.

26. A sheet conveying apparatus according to claim 25, wherein said movable engaging means moves said at least another one of said pins to said retracted position in response to movement of said sheet holding member to said retracted position.

27. A sheet conveying apparatus according to claim 26, wherein said rotatable member comprises a feed roller, said movable engaging means comprises a movable cam and said fixed engaging means comprises a fixed cam, a portion of which overlaps said movable cam, and movement of said movable cam in one direction in response to movement of said sheet holding member into said operative position decreases the extent of said overlap and moves said at least another one of said pins into said projecting position.

28. A sheet conveying apparatus according to claim 27, wherein said sheet holding member comprises an arm gear comprising a gear portion, said synchronizing means comprises a cam gear, rotatably attached to said apparatus and comprising a cam gear portion and a cam slot, said cam gear portion of said cam gear engages said gear portion of said arm gear, and said movable engaging means comprises a cam projection engaging said cam slot.

29. A sheet conveying apparatus according to claim 28, further comprising a feed shaft by which said cam gear is rotatably attached to said apparatus, wherein said cam slot extends toward said feed shaft and displacement of said sheet holding member from said retracted to said operative position displaces said cam slot and said cam projection away from the center of said feed shaft to move said movable cam to move said at least another one of said pins into said projecting position.

30. A pin feed type sheet conveying apparatus for conveying a sheet by engaging pins with openings provided along the side edges of the sheet and by displacing said pins, wherein said apparatus comprises:

a rotatable member for conveying the sheet in response to the rotation of said rotatable member;

a plurality of recesses extending radially and provided along the peripheral surface of said rotatable member, wherein said plurality of pins are movable between a projecting position in which said pins project out of said recesses and a retracted position in which said pins are retracted into said recesses, said plurality of pins rotating with said rotatable member;

fixed engaging means provided along a rotation route of said pin for engaging with and guiding said pin between said projecting position and said retracted position in response to the rotation of said pin, said fixed engaging means guiding and keeping said pin which is at a first position on the rotation route at said projecting position;

movable engaging means provided along the rotation route and for engaging with said pin rotating along the rotation route to guide and move said pin between said projecting position and said retracted position in response to the rotation of said pins, said movable engaging means being movable to keep said pin which is at a second position on the rotation route at either said projecting position or said retracted position;

a sheet holding member movable between an operative position, in which the sheet is held by said rotatable member and a retracted position in which said sheet holding member is retracted from said operative position; and synchronizing means for displacing said movable engaging means in synchronism with the movement of said sheet holding member between said operative position and said retracted position, wherein said fixed engaging means maintains said at least one pin at said projecting position when said sheet holding member is in said operative and said retracted positions.

31. A sheet conveying apparatus comprising:

an engaging member for engaging a hole formed in a sheet to apply a conveyance force to the sheet, said engaging member being rotatable and being movable between an operative position at which said engaging member is engageable with the hole and a retracted position at which said engaging member is not engageable with the hole;

a support member rotatable with said engaging member to support said engaging member in movement between the operative position and the retracted position;

a first guide member fixed relative to said engaging member to guide said engaging member by engaging said rotating engaging member so that said engaging member moves along a predetermined rotation route, said first guide member positioning said engaging member to the operative position at a first position of the rotation route; and a second guide member for guiding said rotating engaging member by engaging said engaging member, said second guide member selectively positioning said engaging member at one of the operative and retracted positions at a second position of the rotation route.

32. An apparatus according to claim 31, further comprising:

a second engaging member for engaging a second hole formed in said sheet to apply the conveyance force to said sheet, and a second support member rotatable with said engaging member to support said engaging member in movement between an operative position at which said engaging member is engageable with the second hole and a retracted position at which said engaging member is not engageable with the second hole, wherein said first engaging member engages with a hole provided at one side end of the sheet and said second engaging member engages with a second hole provided at another side end of the sheet.

33. An apparatus according to claim 31, wherein said engaging member includes a pin for penetrating through the hole.

34. An apparatus according to claim 33, wherein said pin has two projections and said two projections are guided by pinching said first and second guide members.

35. An apparatus according to claim 34, further comprising a third guide member for guiding said engaging member by pinching said two projections between said first and second guide members to engage with said first and second guide members.

36. An apparatus according to claim 33, wherein said support member includes a rotary member rotatable for retractably supporting said pin.

37. An apparatus according to claim 31, wherein said first guide member includes a first cam and said second guide member includes a second cam.

38. An apparatus according to claim 31, further comprising a third guide member for guiding said engaging member by engaging with said engaging member between said first and second guide members to engage with said first and second guide members.

39. An apparatus according to claim 31, wherein said second guide member is rotatably supported with respect to said first guide member.

40. An apparatus according to claim 31, wherein said second guide member is slidable supported with respect to said first guide member.

41. An apparatus according to claim 31, further comprising a sheet guide movable between a guide position for guiding the sheet to a position at which said engaging member engages with the hole provided in the sheet and a non-guiding position retracted from the guiding position.

42. An apparatus according to claim 41, further comprising moving means for moving said engaging member at said second position between the operative position and the retracted position in accordance with movement of said sheet guide.

43. An apparatus according to claim 42, wherein said moving means moves said second guide member to move said engaging member when positioned at the second position to the retracted position when said sheet guide moves to the non-guiding position.

44. An apparatus according to claim 43, wherein said moving means includes a cam for engaging said second guide member to move said second guide member and said cam is moved in accordance with movement of said sheet guide.

45. An apparatus according to claim 44, further comprising a first gear rotating in accordance with movement of said sheet guide and said cam includes a second gear for engaging said first gear to rotate in accordance with movement of said sheet guide.

46. A recording apparatus comprising:

a sheet conveying apparatus including:

an engaging member for engaging a hole formed in a sheet to apply a conveyance force to the sheet, said engaging member being rotatable and being movable between an operative position at which said engaging member is engageable with the hole and a retracted position at which said engaging member is not engageable with the hole, a support member rotatable with said engaging member to support said engaging member between the operative position and the retracted position, a first guide member fixed relative to said engaging member to guide said engaging member by engaging said rotating engaging member so that said engaging member moves along a predetermined rotation route, said first guide member positioning said engaging member at the operative position at a first position of the rotation route, and a second guide member for guiding said rotating engaging member by engaging said engaging member, said second guide member selectively positioning said engaging member at one of the operative and retracted positions at a second position of said rotation route; and recording means for recording on the sheet engaged with and conveyed by said engaging member.

* * * * *

UNITED STATES PATENT AND TRADEMARK OFFICE

CERTIFICATE OF CORRECTION

PATENT NO. : 5,188,270 Page 1 of 3

DATED : February 23, 1993

INVENTOR(S) : Soichi HIRAMATSU, et al.

It is certified that error appears in the above-indentified patent and that said Letters Patent is hereby corrected as shown below:

COLUMN 1:

Line 12, "INVENTION 1. Field" should read --INVENTION ¶ 1. Field--.

COLUMN 2:

Line 4, "at" should be deleted;

Line 17, "force of" should read --by--;

Line 18, "by" should read --force of--; and "5," should read --5;--.

Line 25, "to" should be deleted.

COLUMN 3:

Line 40, "pins" should read --pin--.

UNITED STATES PATENT AND TRADEMARK OFFICE

CERTIFICATE OF CORRECTION

PATENT NO. : 5,188,270 Page 2 of 3

DATED : February 23, 1993

INVENTOR(S) : Soichi HIRAMATSU, et al.

It is certified that error appears in the above-indentified patent and that said Letters Patent is hereby corrected as shown below:

COLUMN 4:

Line 29, "operably" should read --operable--.

COLUMN 5:

Line 10, "movably" should read --moveable--.

COLUMN 6:

Line 1, "clear" should read --clear image--.

COLUMN 8:

Line 62, "result" should read --result,--.

COLUMN 10:

Line 36, "move" should read --moved--.

COLUMN 11:

Line 58, "a" (second occurrence) should be deleted;

Line 65, "a" (first occurrence) should read --an--.

UNITED STATES PATENT AND TRADEMARK OFFICE

CERTIFICATE OF CORRECTION

PATENT NO. : 5,188,270 Page 3 of 3

DATED : February 23, 1993

INVENTOR(S) : Soichi HIRAMATSU, et al.

It is certified that error appears in the above-indentified patent and that said Letters Patent is hereby corrected as shown below:

COLUMN 12:

Line 14, "thereto," should read --thereto;--

Line 19, "thereto said;" should read --thereto;--.

COLUMN 14:

Line 61, "surfaces" should read --surface--.

COLUMN 18:

Line 13, "slidable" should read --slidably--;

Line 16, "guide" should read --guiding--.

Signed and Sealed this

Twenty-ninth Day of March, 1994

Bruce Lehman

*Attest:*

BRUCE LEHMAN

*Attesting Officer*

*Commissioner of Patents and Trademarks*